United States Patent [19]

Palz

[11] 4,369,954

[45] Jan. 25, 1983

[54] REGENERATIVE AIR PREHEATER WITH IMPROVED INSULATION BETWEEN COMBUSTION CHAMBER AND CHECKER SHAFT

[75] Inventor: Helmut Palz, Wiesbaden, Fed. Rep. of Germany

[73] Assignee: Didier-Werke AG, Wiesbaden, Fed. Rep. of Germany

[21] Appl. No.: 169,198

[22] Filed: Jul. 15, 1980

[30] Foreign Application Priority Data

Jul. 21, 1979 [DE] Fed. Rep. of Germany ..... 2929718

[51] Int. Cl.[3] ..... C21B 9/02

[52] U.S. Cl. ..... 266/139; 432/217

[58] Field of Search ..... 432/217, 218; 266/139

[56] References Cited

U.S. PATENT DOCUMENTS

| | | | |
|---|---|---|---|
| 2,420,373 | 5/1947 | Hogberg | 432/217 |
| 3,550,918 | 12/1970 | Van Laar | 432/217 |
| 3,806,313 | 4/1974 | Van Laar | 432/217 |
| 4,201,543 | 5/1980 | Hyde | 432/217 |

FOREIGN PATENT DOCUMENTS

| | | | |
|---|---|---|---|
| 1938432 | 7/1972 | Fed. Rep. of Germany | 266/139 |

*Primary Examiner*—M. J. Andrews

*Attorney, Agent, or Firm*—Wenderoth, Lind & Ponack

[57] ABSTRACT

A regenerative air preheater includes a masonry casing having therein a combustion chamber and a checker shaft with checker bricks, and a separating wall between the combustion chamber and checker shaft. A space is provided between the separating wall and the checker bricks. Insulating material comprising fireproof fiber material is positioned within the space. The insulating material is structurally free of the separating wall.

10 Claims, 5 Drawing Figures

REGENERATIVE AIR PREHEATER WITH IMPROVED INSULATION BETWEEN COMBUSTION CHAMBER AND CHECKER SHAFT

BACKGROUND OF THE INVENTION

The present invention relates to a regenerative air preheater having improved insulation between the combustion chamber and checker shaft of the regenerative air preheater.

A typical regenerative air preheater includes a masonry casing having therein a combustion chamber and a checker shaft set with checker bricks, and a separating wall between the combustion chamber and the checker shaft. During operation of the internal shaft regenerative air preheater, considerable temperature differences exist between the combustion chamber side and the checker shaft side of the separating wall, particularly in the lower portion of the separating wall. As a result of such temperature differences, and of the varying expansion of the fireproof stone or brick material of the separating wall, the wall has a tendency to lean toward the colder side, i.e., the checker shaft side, due to the phenomenon known as the "bimetallic effect". This results in stresses which cause cracks and disintegration of the stone or bricks of the separating wall, as well as in the anchoring bricks attaching the separating wall to the casing wall of the regenerative air preheater. This in turn can result in leaks between the combustion chamber and the checker shaft.

Previous attempts to prevent these destructive and disadvantageous occurrences in regenerative air preheaters used to produce hot wind or blast temperatures up to 1300° C. are known, for example, from West German DT-AS 19 38 432. Such previous attempts consist essentially in dividing the separating wall and the casing wall in the area of the combustion chamber into several vertical stone or brick layers with partitions present at least in the cold state of the preheater and to provide an insulation layer consisting of insulation stones or bricks on the side of the partitions in the area opposite to the combustion chamber.

Such attempts involving the placing of a separating wall layer of insulating stones or bricks on the checker shaft side of the separating wall have not had the effect that was desired, since the insulation stones have a high porosity and are relatively mechanically weak. The relatively high temperature gradient across the insulating stones results in high expansion on one side thereof, and this results in a considerable degree of internal tension within the insulating stones. Thus, the insulating stones become destroyed after a relatively short period of time.

If a separating wall layer consisting of insulating stones is packed between two hard stone wall layers, the result is a natural mechanical weakening of the overall separating wall. Additionally, the hard stone layer on the checker shaft side remains considerably cooler and expands less than the section of the casing wall next to the combustion chamber in which it is anchored. This results in the anchors being subjected to the destructive forces of expansion.

It is furthermore known from the above mentioned DT-AS 19 38 432 to provide a metal plate of heat resistant steel in the separating wall, which metal plate even after long periods of use maintains the separating wall in a gastight condition.

SUMMARY OF THE INVENTION

With the above discussion in mind, it is the object of the present invention to provide an improved separating wall construction through an improved arrangement and composition of the insulation, to thereby extend the useful life of the separating wall and the overall regenerative air preheater.

This object is achieved in accordance with the present invention by providing that the insulation comprises a space between the separating wall and the checker bricks, insulating material comprising fireproof fiber material positioned within the space, and with the insulating material being structurally free of the separating wall. In this manner, the insulation is removed from the separating wall itself, such that the separating wall can be constructed throughout its entire cross-section of hard stones with corresponding high physical strength characteristics. Thus, there is provided a stable wall having a cross-section maintained at essentially equalized temperatures by the improved insulation of the invention. This prevents the formation of cracks and destructive heat expansion within the construction of the separating wall. The production of the insulation itself requires very little effort and cost, since it is relatively easy to provide between the separating wall and the checker bricks a space suitable for containing the fiber materials of the insulation.

In accordance with a further feature of the present invention, it is advantageous to place a heat-resistant foil material, preferably of refined steel, between the insulating material and the checker bricks. This makes it easier to place or fill the fiber material into the space, keep the air from streaming or entering into the checker shaft, and also helps to form a gastight seal between the combustion chamber and the checker shaft. It is advantageous to use a foil material consisting of rectangular pieces or sheets having a thickness of from 0.1–0.2 mm, with the sheets being overlapped and having upper edges, for example, in the form of flanges, crimped between respective adjacent layers of the checker bricks.

In accordance with a further feature of the present invention, the insulating material comprises insulating "wool type" material having a thickness of from 50–60 mm. Furthermore, the insulating material is, at an upper edge thereof and at lateral edges thereof adjacent the casing walls, impregnated with an air-hardening mortar material, for example, a soluble sodium mortar. This protects the insulating wool from being carried away by wind or blast streams or gas in the areas of the edges of the insulating wool.

In accordance with a further feature of the present invention, the space between the separating wall and the checker bricks includes an extended or widened area extending into the separating wall. Preferably, this widened area is at the lower portion of the separating wall and extends approximately half-way up the height thereof. The insulating material is entirely positioned within the widened area of the space, and the separating wall includes an outcropping or horizontal flange which at least partially covers the insulating material.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
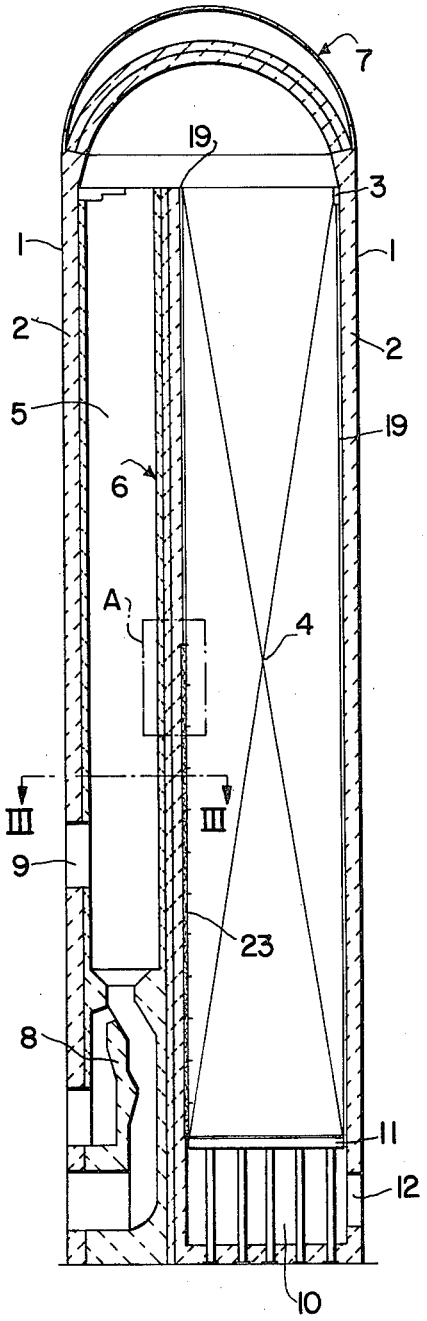
FIG. 1 is a vertical section through an interior shaft regenerative air preheater including the improvement of the present invention.
Figure 2:
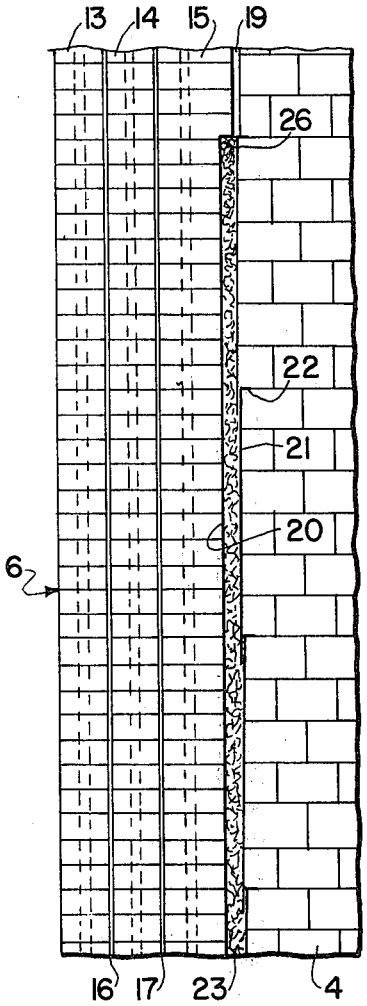
FIG. 2 is an enlarged view showing detail A of FIG. 1.
Figure 3:
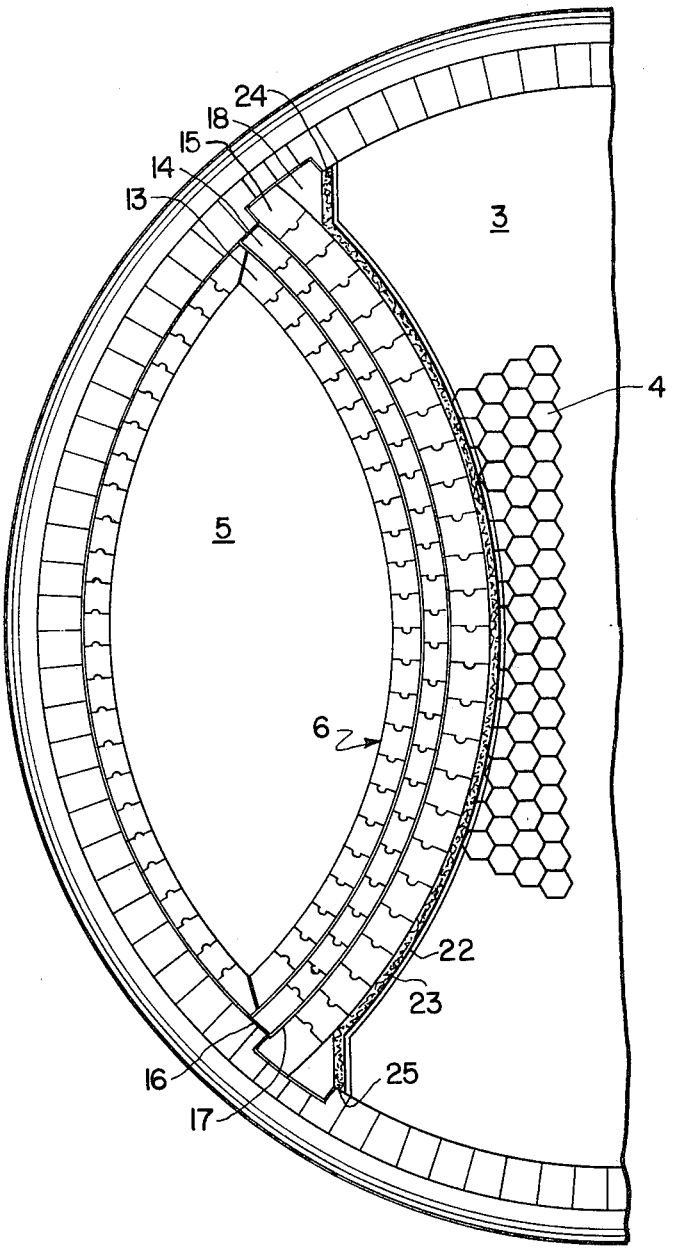
FIG. 3 is a horizontal section, on an enlarged scale, taken along line III—III of FIG. 1.

With particular reference now to FIGS. 1–3 of the drawings, the improved blast furnace construction according to the present invention will be described in more detail.

The blast furnace includes a sheet metal casing 1 and a masonry casing wall 2. Masonry casing includes therein a checker shaft 3 set with or occupied by checker bricks 4, and a combustion chamber 5. Combustion chamber 5 and checker shaft 3 are separated from each other by an airtight separating wall 6 and are covered by a common dome 7. At the base of the combustion chamber, there is a burner 8, above which is provided a hot blast or wind outlet 9. A waste gas outlet 12 and a cold blast or wind inlet, not shown, are located in a chamber 10 below a grid 11.

The separating wall 6 consists of three layers 13, 14 and 15 of highly fired fireproof bricks with good physical strength characteristics. Between adjacent brick layers are provided vertical expansion or slide partitions 16, 17. Layer 15 of the separating wall is attached to the casing wall 2 of the regenerative air preheater by means of bearing bricks 18, as shown in FIG. 3. Bearing bricks 18 form the ends of the separating wall 6 in the direction of the checker shaft 3. Checker bricks 4 are set within a space 19 between separating wall 6 and the surrounding casing wall 2.

In the lower half of the regenerative air preheater an area 20 of space 19 adjacent the separating wall 6 is expanded or widened by approximately one-third. Within the widened area 20 is filled a fireproof fiber material 23 which is structurally free from and unconnected to the separating wall. There is provided a heat resistant, preferably refined steel, foil material 21 positioned between the insulating material 23 and the checker bricks 4. Preferably, the foil material comprises a plurality of sections, such as rectangular sheets, which overlap as shown particularly in FIG. 2 at adjacent tops and side edges of the foil sections. An upper edge in the form of a bend or flange 22 of each foil sheet is crimped between respective adjacent layers of the checker bricks and is securely held therebetween, as particularly shown also in FIG. 2. The foil sheets are preferably of a thickness of from 0.1–0.2 mm.

The insulating material 23 preferably comprises an insulating wool material having a thickness of from 50–60 mm and compressed to a density of about 250 $kp/m^2$.

To increase the hardness of the lateral edges 24, 25 and the upper edge 26 of the insulating material, such edges are impregnated with an air hardening mortor material, such as a soluble sodium mortar, to a depth of approximately 200 mm.

Figure 4:
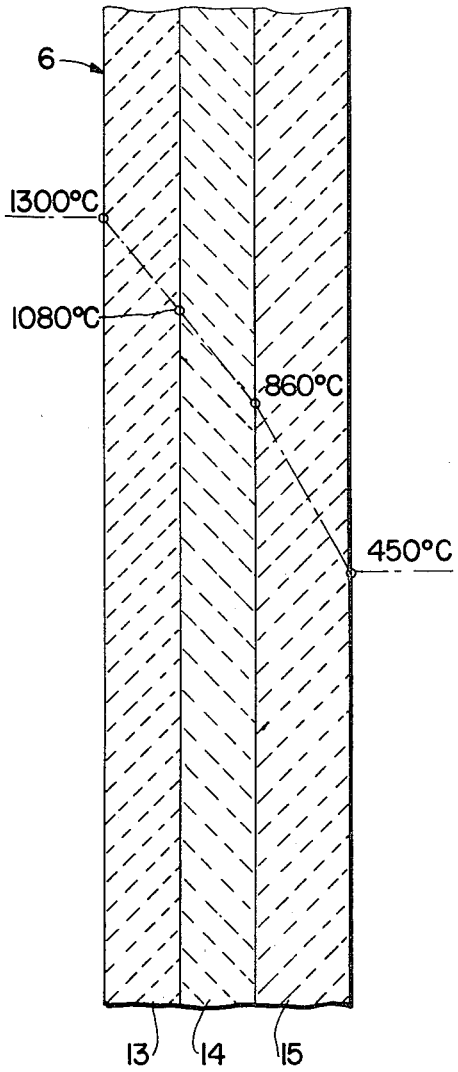
FIG. 4 PRIOR ART
FIG. 4 is a schematic representation illustrating the temperature gradients existing in an uninsulated separating wall.

FIG. 4 graphically illustrates the temperature gradient in a non-insulated separating wall. It will be apparent that the temperature gradient falls off steeply between the combustion chamber and the checker shaft, with a total temperature drop of 850° C. This high temperature gradient causes a strong bi-metallic effect in the separating wall 6 and creates strong tensions in the bricks of each layer 13, 14, 15, with the result that damage to the separating wall will occur.

Figure 5:
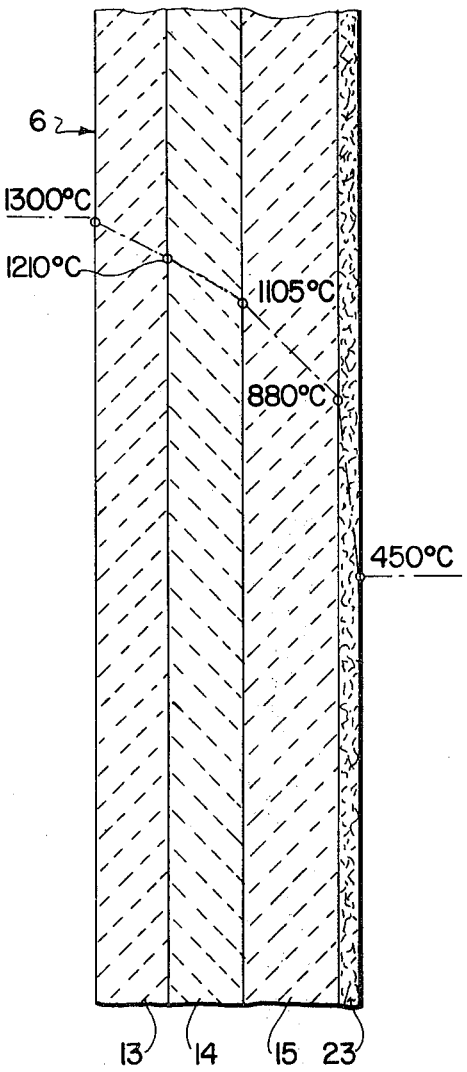
FIG. 5 is a schematic representation illustrating the temperature gradients existing in a separating wall insulated according to the present invention.

In contrast, the temperature gradient of a separating wall insulated according to the present invention will be apparent from FIG. 5. The temperature gradient according to the present invention is much flatter, whereby there is a total temperature drop within the separating wall itself of only 420° C. Thus, the destructive heat tensions are virtually eliminated and no longer occur. Furthermore, since the insulation layer 23 itself is no longer a structural part of the separating wall, the destructive influences caused by tension differences in the insulation material of the individual separating wall layers is eliminated from the outset.

Although the present invention has been described and illustrated with regard to a preferred embodiment thereof, it will be apparent to those skilled in the art that various modifications may be made without departing from the scope of the present invention.

What is claimed is:

1. In a regenerative air preheater of the type including a masonry casing having therein a combustion chamber and a checker shaft set with checker bricks, and a separating wall between said combustion chamber and said checker shaft, the improvement of insulation means between said combustion chamber and said checker shaft, wherein said insulation means comprises:

a space between said separating wall and said checker bricks;

insulating material comprising fireproof fiber material positioned within said space; and said insulating material being structurally free of said separating wall.

2. The improvement claimed in claim 1, further comprising heat resistant foil material positioned between said insulating material and said checker bricks.

3. The improvement claimed in claim 2, wherein said foil material comprises rectangular sheets having a thickness of from 0.1–0.2 mm, said sheets being overlapped and having upper edges crimped between respective adjacent layers of said checker bricks.

4. The improvement claimed in claims 1 or 2, wherein said insulating material comprises insulating wool having a thickness of from 50–60 mm.

5. The improvement claimed in claim 4, wherein said insulating material is at an upper edge thereof and at lateral edges thereof adjacent said casing impregnated with an air hardening mortar material.

6. The improvement claimed in claim 5, wherein said mortor material comprises soluble sodium mortar.

7. The improvement claimed in claims 1 or 2, wherein said space includes a widened area extending into said separating wall.

8. The improvement claimed in claim 7, wherein said widened area is of a height equal to approximately one-half the height of said separating wall.

9. The improvement claimed in claim 7, wherein said insulating material is entirely positioned within said widened area.

10. The improvement claimed in claim 9, wherein said separating wall includes an outcropping which at least partially covers said insulating material.

* * * * *